US006164527A

United States Patent [19]

Garey

[11] Patent Number: 6,164,527

[45] Date of Patent: Dec. 26, 2000

[54] AUTOMATIC VARIABLE POSITION MAILBOX

[76] Inventor: Peter A. Garey, 3637 Millers Station Rd., Manchester, Md. 21102

[21] Appl. No.: 09/225,766

[22] Filed: Jan. 5, 1999

Related U.S. Application Data

[60] Provisional application No. 60/070,476, Jan. 5, 1998.

[51] Int. Cl.[7] ..... B65D 91/00

[52] U.S. Cl. ..... 232/39; 248/131; 248/349.1; 248/415; 248/424

[58] Field of Search ..... 232/17, 39, 45, 232/36, 37; 248/415, 417, 418, 349.1, 131, 145, 125.7, 424, 425, 429; 340/569

[56] References Cited

U.S. PATENT DOCUMENTS

| | | | |
|---|---|---|---|
| 3,497,078 | 2/1970 | Nash | 232/39 |
| 3,802,656 | 4/1974 | Virblas . | |
| 3,870,262 | 3/1975 | Manning, Jr. | 232/39 X |
| 4,113,213 | 9/1978 | Gay et al. | 232/39 X |
| 4,264,032 | 4/1981 | Vanis . | |
| 4,403,760 | 9/1983 | Alvermann . | |
| 4,484,705 | 11/1984 | Sande . | |
| 4,852,847 | 8/1989 | Pagel . | |
| 4,869,426 | 9/1989 | Powers et al. | 232/39 |
| 4,995,576 | 2/1991 | Kieswetter . | |
| 5,167,364 | 12/1992 | Wenning . | |
| 5,400,958 | 3/1995 | Walker | 232/39 |
| 5,458,286 | 10/1995 | Paschal . | |
| 5,524,853 | 6/1996 | Varlaro . | |
| 5,622,343 | 4/1997 | Morton . | |
| 5,699,989 | 12/1997 | Guthrie . | |
| 5,779,202 | 7/1998 | Black et al. | 232/39 X |
| 5,941,455 | 8/1999 | Cutugno | 232/39 |

*Primary Examiner*—Terry Lee Melius
*Assistant Examiner*—William L. Miller
*Attorney, Agent, or Firm*—Law Offices of Royal W. Craig

[57] ABSTRACT

A variable position mailbox comprising an automatically controlled mailbox support structure for translating a mailbox through a series of preset positions including a night storage position, a mail delivery position, and a mail pick-up position such that mail may be retrieved safely and conveniently by the homeowner away from the traffic bearing road, and the mailbox may be conveniently stored in a position away from the road during the nighttime to discourage vandalism.

16 Claims, 6 Drawing Sheets

AUTOMATIC VARIABLE POSITION MAILBOX

CROSS-REFERENCE TO RELATED APPLICATIONS

The present application is based on provisional application Ser. No. 60/070,476, filed Jan. 5, 1998.

BACKGROUND OF THE INVENTION

1. Field of the Invention

This invention relates generally to the field of mailboxes, and more particularly to an improved variable position mailbox comprising an automatically controlled mailbox support structure for translating a mailbox through a series of preset positions including a night storage position, a mail delivery position, and a mail pick-up position such that mail may be retrieved safely and conveniently by the homeowner away from the traffic bearing road, and the mailbox may be conveniently stored in a position away from the road during the nighttime to discourage vandalism.

2. Description of the Background

Retrieving one's mail from a residential street side mailbox has traditionally been a rather hazardous endeavor. A mailbox positioned directly next to the street is often convenient for the mailman's delivery, but places the homeowner at risk of serious injury by careless drivers when the homeowner has to step near to roadside to retrieve his or her mail. In an attempt to reduce the risks associated with retrieving one's mail from a roadside mailbox, attempts have been made in the past to provide a rotatably mounted mailbox. However, such devices have not been successful in fully alleviating the dangers associated with retrieving mail from a roadside mailbox, as the homeowner still must come dangerously close to the roadside in order to pivot the mailbox to retrieve his or her mail. Likewise, such previously contrived rotatable mailboxes require the homeowner to actuate the pivoting action, likewise exposing the homeowner not only to the hazards of passing traffic, but also exposing the homeowner to the elements on harsh weather days.

While attempts have been made in the past to provide a pivoting mailbox, none of the prior art devices have been able to incorporate an automatic control system for pivoting the mailbox through a daily cycle of mail delivery, mail pickup, and nighttime storage positions. For example, U.S. Pat. No. 5,524,853 to Varlaro discloses a swinging mailbox support which is always biased towards a single position.

U.S. Pat. No. 5,458,286 to Paschal discloses a rotatable mailbox mount which may be manually pivoted and locked in one of two preset positions.

U.S. Pat. No. 5,167,364 to Wenning discloses a rotatable mailbox mount for manually pivoting a mailbox from a mail receiving position to a mail delivering position.

U.S. Pat. No. 4,484,705 to Sande discloses a manually rotatable mailbox support.

Finally, U.S. Pat. No. 4,264,032 discloses a manually operable, non-rotatable, telescoping mailbox support for transporting a mailbox from the roadside to the front of a person's house.

Unfortunately, none of the prior art devices have been able to provide an automatically controlled pivoting mailbox for carrying a mailbox through a series of preset positions without endangering the homeowner and requiring the homeowner to physically manipulate the bulky mailbox support. Thus, there remains a need for a means for rotatably mounting a mailbox which enables a mail delivery person to easily access the mailbox, while allowing the homeowner equally easy and safe access to receive the mail at the end of the day without risking exposure to oncoming traffic or adverse weather conditions.

SUMMARY OF THE INVENTION

One primary object of the present invention is to provide a rotatable mailbox support for automatically transporting a mailbox through a series of preset positions.

It is another object of the present invention to provide a rotatable mailbox support which simultaneously enables a delivery person to access the mailbox from the roadside while enabling a homeowner to access the mailbox from any desired position on the homeowner's property.

It is yet another object of the present invention to provide an automatically controlled pivoting mailbox support which varies the position of the mailbox in accordance with opening and closure of the mailbox door.

It is still yet another object of the present invention to provide an automatically controlled rotatable mailbox support which cycles the angular position of the mailbox through a mail delivery position, a mail pick-up position, and a mailbox storage position.

In accordance with the above objects, an automatically controlled variable position mailbox is provided which, after mail has been delivered by a postal delivery person, automatically moves from a mail delivery position adjacent the roadside to a position away from the roadside for the homeowner to retrieve the mail, and which after the mail has been removed from the box by the homeowner automatically moves again to a night storage position where the mailbox is less likely to be vandalized.

To accomplish these varied movements, a mounting post is set back from the side of the road approximately two feet and the mail box is mounted on a horizontal extensible support arm extending outward from a rotatable disk which is positioned on top of the post. The horizontal support arm is equipped with a counterbalance weight at one end and supports a standard mailbox on its opposite end. The rotatable disk in turn supports the entire horizontal support arm, and rotates in either a clockwise or counterclockwise direction, causing the mailbox to travel through an arc in a horizontal plane.

A small, low voltage electric motor mounted on the side of the vertical support post engages the rotatable disk to translate the mailbox through its arc from a mail delivery position adjacent the roadside, to a mail pick-up position adjacent to the homeowners driveway or walkway and away from the roadside, and finally to a nighttime storage position which is even further away from the roadside. A means is provided by any number of commonly available devices such as a series of switches and a timer to control the electric motor as it drives the mailbox through its series of predesignated stopping points. The driving mechanism is designed to be of low torque, such that if the mailbox or supporting arm should come in contact with any foreign object, the motor will slip against the rotatable disk to avoid damaging either the mailbox or the object which it encounters, and will eventually stop after a predesignated amount of time has elapsed.

A timer is also provided such that in the event that mail is not delivered as on a Sunday or a Holiday, the mailbox does not cycle through its above-described motions, but rather remains in its night storage position until such time as mail delivery is resumed. Likewise, in the event that mail is not removed from the mailbox on any given day, the timer will similarly move the mailbox to the predesignated night storage position after a preprogrammed time is reached.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
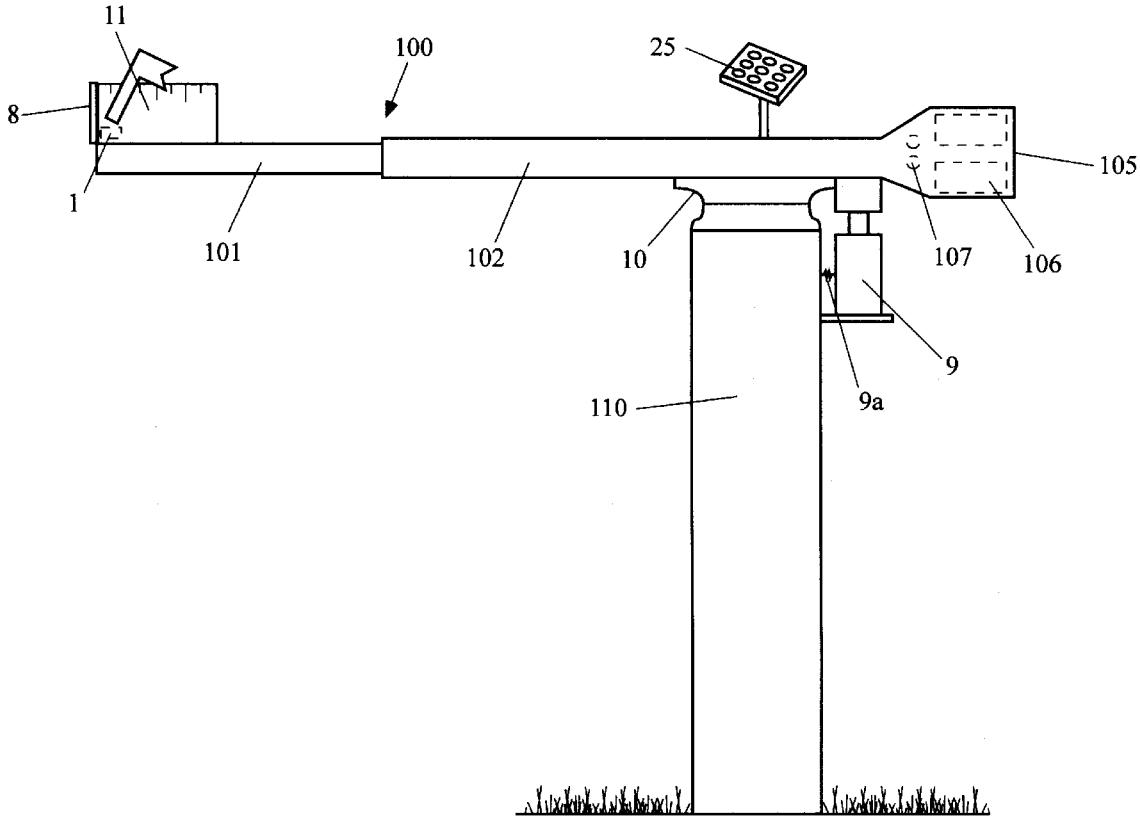
FIG. 1 is a side view of the automatic variable position mailbox of the present invention.

FIG. 1 shows a side view of the automatic variable position mailbox of the present invention. The variable position mailbox generally comprises a mailbox 11 fixedly attached to a first end of a horizontal arm 100, which horizontal arm is in turn rotatably mounted atop a vertical support post 110. Horizontal arm 100 has a telescoping section 101 which is slidably mounted within main horizontal arm support section 102 in order to provide a variable position mailbox which is adaptable to properties of varying dimensions. A second end of horizontal arm 100 comprises a housing 105, in which is housed a counterweight 106 and power supply 107. Counterweight 106 preferably comprises commercially available building bricks or other weights, although any similarly configured weighted device would suffice. Likewise, power supply 107 preferably comprises a standard battery power supply, although other power supply devices could likewise be used, such as household alternating current. Likewise, power supply 107 may comprise rechargeable batteries powered by a solar array 25 positioned atop horizontal arm 100. A presently preferred solar array for use in such configuration is commercially available from Radio Shack under Model Number 276-124.

Figure 2:
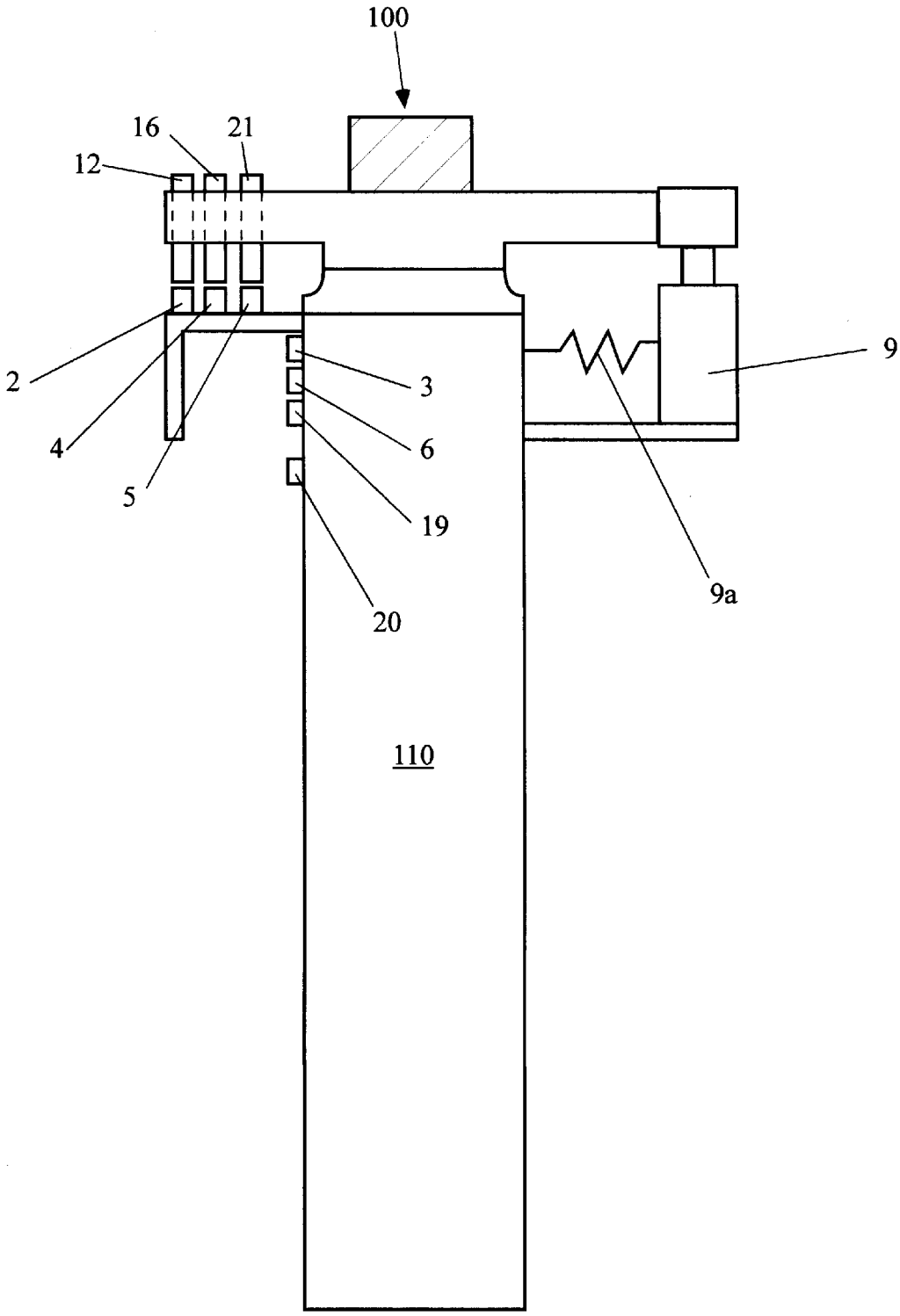
FIG. 2 is a close-up side view of the mounting assembly of the present invention.
Figure 3:
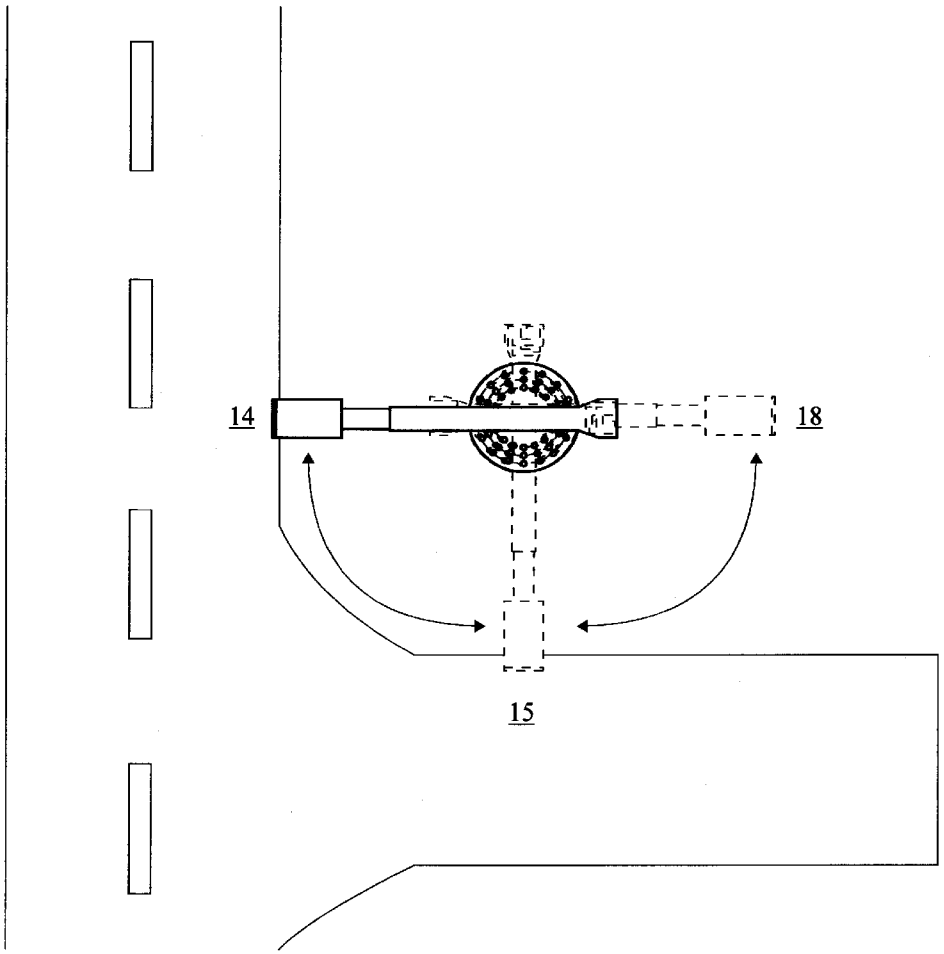
FIG. 3 is an ariel view of the automatic variable position mailbox of the present invention depicting in shadow the variable positions of the mailbox.

Hingedly attached to the front of mailbox 11 is a standard downwardly swinging mailbox door 8. A normally open magnetic switch 1 (i.e., open or "off" when the mailbox door is in its closed position) is mounted on the interior of mailbox 11, immediately adjacent mailbox door 8 and engaged thereby when mailbox door 8 is closed. A presently preferred switch 1 is commercially available from Radio Shack under Model Number 275-1565. After mail has been delivered, magnetic switch 1 is activated as mailbox door 8 swings upward to its closed position and the rear surface of mailbox door 8 depresses switch 1. When activated, switch 1 closes an electrical circuit to direct electrical current from power supply 107 to a first timer 3 (explained in detail below) which is mounted adjacent to vertical support post 110 just below horizontal arm 100 (FIG. 2). Timer 3 provides a delay of approximately 60 seconds before it closes a circuit to direct electrical current from power supply 107 to an electric driving motor 9 which rotates a top disk 10. A presently preferred driving motor is commercially available from Tamiya under Model Number 7200. Electric driving motor 9 is mounted on a side of vertical support post 110, and is preferably biased towards and held against the outer edge of top disk 10 using a tension spring 9*a*, creating a friction drive system. The drive mechanism is configured such that it will allow slippage should the mailbox or arm come in contact with any foreign object. The amount of slippage is adjustable by varying the force holding the drive motor shaft against the top disk 10. While the presently preferred method is a tension spring 9*a*, other equivalent clutch devices may be used. Horizontal arm 100 is fixedly attached to rotating top disk 10, such that rotation of top disk 10 causes mail box 11 to slowly move in either a clockwise or counterclockwise direction from the initial roadside mail delivery position to a mail pick-up position away from the roadside, as shown in FIG. 3.

Figure 1A:
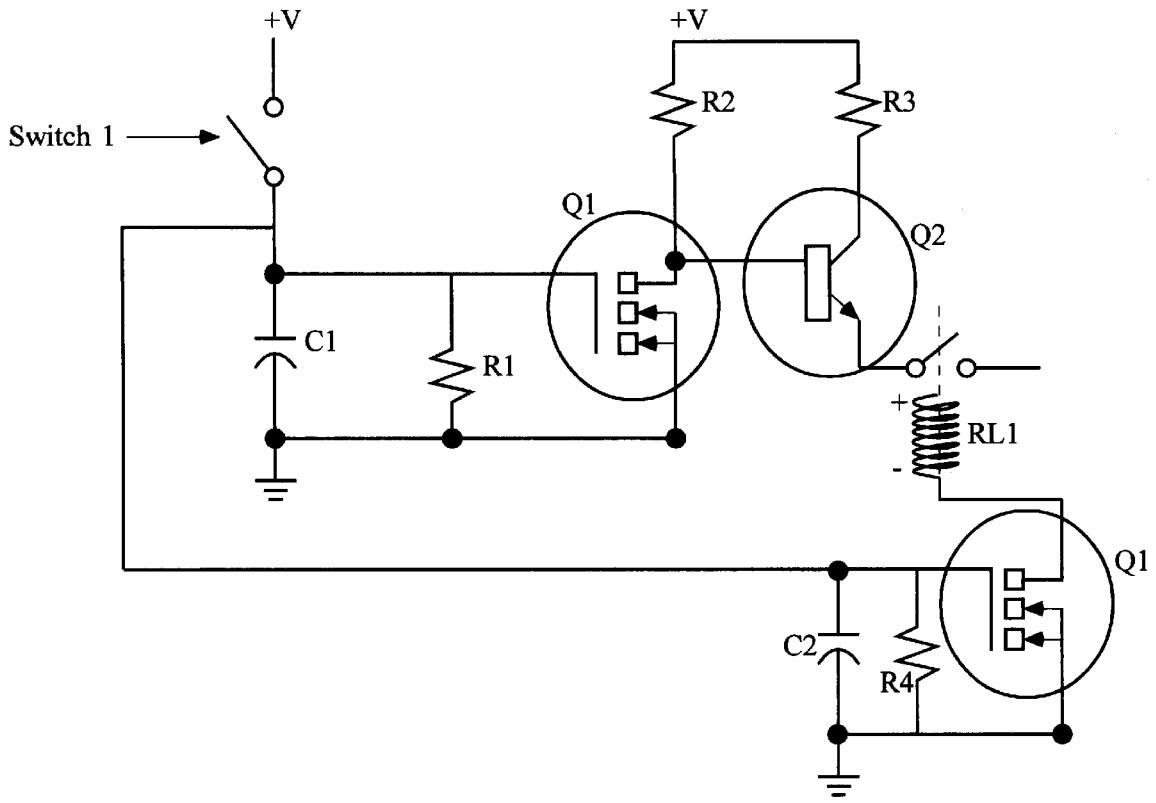
FIG. 1*a* is a schematic diagram of the timer circuit of the present invention.

As mentioned above, timer circuit 3 allows a delay of approximately 60 seconds between the time at which the mailbox door is closed and the closure of an electrical circuit to direct current to driving motor 9 to initiate movement of the variable position mailbox from the mail delivery position to the mail pick-up position. An exemplary timer circuit 3 is shown in FIG. 1A, and comprises a first capacitor C1 having a capacitance of 3.3 $\mu$F arranged in parallel with a 1,000,000 Ohm resister R1 and a N Channel Power NOSFET Q1, which in turn is arranged in series with a 10,000 Ohm resistor R2, a 1,000 Ohm resistor R3, and a NPN Transistor Q2. A suitable N Channel Power NOSFET Q1 is readily commercially available from Radio Shack as Catalog Number 276-2072, and a suitable NPN Transistor is readily commercially available from Radio Shack as Catalog Number 276-1617. Transistor Q2 in turn is arranged in series with the positive terminal of a SPDT relay RL1, which likewise is readily commercially available from Radio Shack as Catalog Number 275-243.

Arranged in parallel with the above circuitry is a second capacitor C2 having a capacitance of 47 $\mu$F. Capacitor C2 is coupled in parallel with a 1,000,000 Ohm resister R1 and another N Channel Power NOSFET Q1. The drain of NOSFET Q1 is connected to the negative terminal of SPDT Relay RL1.

With reference to the schematic diagram of FIG. 1A, when switch 1 is closed (via the opening of mailbox door 8), electrical current from power supply 107 triggers timer circuit 3 and fully charges both capacitors C1 and C2. After the mailbox door has closed, thus reopening switch 1 and terminating the flow of current from power supply 107 to timer circuit 3, capacitor C1 continuously directs voltage to NOSFET Q1, keeping the gate closed until resistor R1 has fully drained the charge from capacitor C1. While the gate remains closed, current is supplied to NPN Transistor Q2, which transistor in turn holds the circuit open, thus preventing current from reaching relay RL1. After approximately 60 seconds, resistor R1 fully drains the charge from capacitor C1, in turn causing the gate to open, thus terminating the current flow from NOSFET Q1 to NPN Transistor Q2. As the power supply to NPN Transistor Q2 is terminated, current is allowed to pass to relay RL1, in turn directing electrical current from the power source through limit switch 2 and onward to motor 9, causing motor 9 to drive top disc 10 through its horizontal arc movement. Meanwhile, capacitor C2 remains charged as it takes two minutes to discharge through resistor R4. Capacitor C2 keeps the gate closed at a second NOSFET Q1 which completes the negative ground to Relay RL1. After approximately two minutes have elapsed, capacitor C2 is fully discharged, causing the second gate to open. This in turn breaks the negative ground of relay RL1, causing it to open and terminating the power supply to driving motor 9. Thus, in the event that driving motor 9 continues to run for more than approximately two minutes, for example where an object impedes further rotation of horizontal arm 100 while motor 9 continues to slip against rotating top disk 10, relay RL1 will open to terminate current flow from the power source 107 to electric motor 9.

It should be noted, however, that the timer circuit shown in FIG. 1A is merely exemplary of one suitable analog timer, and that any similarly configured analog or digital dual mode timer circuit could likewise be used.

FIG. 2 is a close-up side view of the mounting assembly of the present invention, showing a series of limit switches 2, 4, and 5, each of which is operated by a respective peg 12, 16, and 21. All three limit switches 2, 4, and 5 are rocker type switches which allow the trip peg to rock the switch to an "OFF" (or open switch) position when the disk is turning in one direction, and to rock the switch to an "ON" (or closed switch) position when turning in the opposite direction. A presently preferred limit switch is commercially available from Radio Shack under Model Number 275-691. However, other types of switches may be used which will achieve the same goal.

Figure 4:
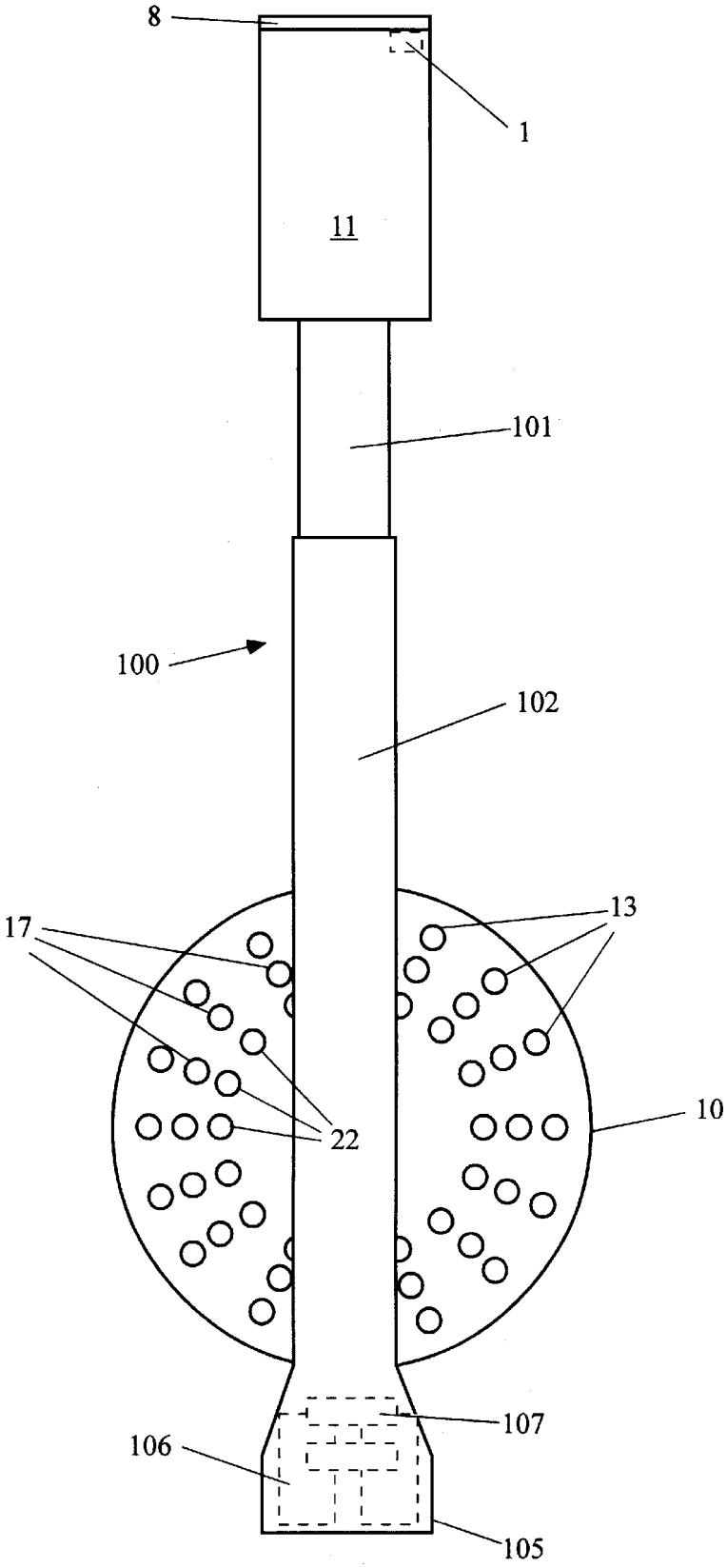
FIG. 4 is a top view of the automatic variable position mailbox of the present invention.

As shown in the top view of top disk 10, horizontal support arm 100, and mailbox 11 of FIG. 4, pegs 12, 16, and 21 are positioned in holes 13, 17, and 22, respectively, in top disk 10, according to the homeowner's initial calibration (as explained in greater detail below). Holes 13, 17, and 22 in top disk 10 are arranged in circular patterns whereby holes 22 form an inner circle near the center of top disk 10, holes 17 form an intermediate circle circumscribing holes 22, and holes 13 form an outer circle circumscribing holes 17. During the initial assembly and set-up of the current invention, the installer and/or homeowner manually turns the disk 10 to position the mail box 11 in the most convenient or preferred area for safe mail pick up. A trip peg 12 is then inserted in one of the outermost holes 13. The homeowner simply places trip peg 12 into whichever hole 13 is most directly overtop of limit switch 2. The same procedure is used during set-up to determine which hole in the innermost ring of holes is correct for stopping the mailbox in the delivery position, and the remaining ring of holes for stopping the mailbox in the night storage position.

Figure 2A:
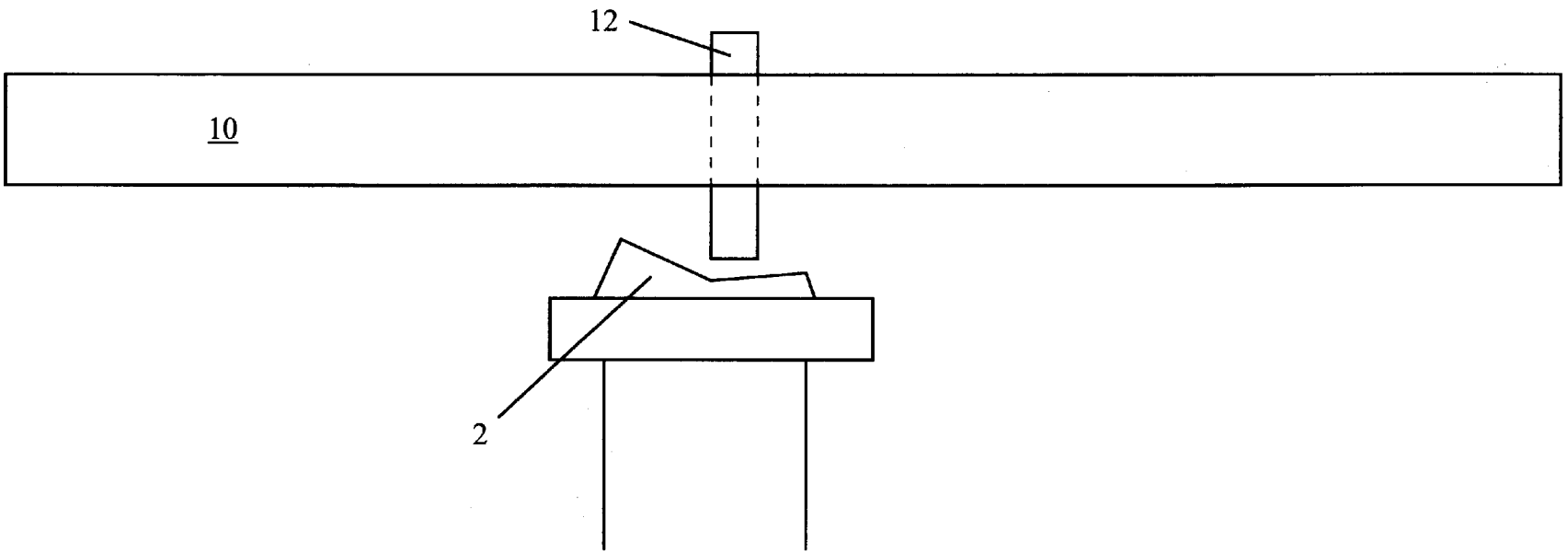
FIG. 2*a* is a side view of the top disk carrying a peg for engaging a rocker type limit switch.

As explained above, closing mailbox door 8 after mail has been delivered activates switch 1 and timer circuit 3 (after the preset delay) to slowly move the mailbox from the mail delivery position 14 to the mail pick-up position 15, as seen in FIG. 3. As shown in the side view top disk 10, peg 12, and rocker limit switch 2 of FIG. 2A, as the mailbox travels through its horizontal arc to the mail pick-up position 15, peg 12 likewise approaches limit switch 2 until the bottom of peg 12 engages the raised rocker arm of limit switch 2. Activation of limit switch 2 by peg 12 terminates the flow of current to motor 9, thus stopping the rotation of the mailbox once it has reached the mail pick-up position. Limit switch 2 simultaneously redirects flow of current from the power source to a second timer 6 which is mounted adjacent timer circuit 3, as shown on FIG. 2. Timer circuit 6 is identical in its configuration to that of timer circuit 3, with the sole exception that the capacitors used in timer circuit 6 provide a longer time delay. More specifically, with reference to FIG. 1A, capacitor C1 is provided a capacitance of 100 $\mu$F, while capacitor C2 is provided a capacitance of 220 $\mu$F.

Once the homeowner has returned home and retrieves their mail from the mailbox, switch 1 is once again activated through closure of mailbox door 8, closing the electrical circuit running from the power source 107 to timer switch 6. Timer switch 6 then initiates its timer sequence, preferably 60 seconds, after which it directs electrical current to driving motor 9 to again rotate top disk 10 in a counterclockwise direction from its mail pickup position 15 to a nighttime mailbox storage position 18 to prevent vandalism by passers by on the roadway.

As the mailbox travels through its circular arc from the mail pick-up position 15 to the night storage position 18, peg 16 positioned in one of holes 17 in top disk 10 likewise approaches limit switch 4 until the bottom of peg 16 engages the raised rocker arm of limit switch 4. Activation of limit switch 4 by peg 16 terminates the flow of current to motor 9, thus stopping the rotation of the mailbox once it has reached the night storage position.

A low voltage powered timer 19 activates a double throw, double pole relay 20 at any pre-programmed time of day, and preferably early the next morning. A presently preferred low voltage powered timer 19 is commercially available from Advance under Model "Digital Alarm," and a presently preferred double pole relay 20 is commercially available from Radio Shack under Model Number 275-206. The double throw, double pole relay 20 breaks both the positive and negative connections that have been powering the motor through switches 1, 2, 3, and 4, and makes a reverse polarity connection to the motor passing through a third limit switch 5 causing the motor 9 to run in an opposite direction from that which it was previously running.

Timing device 19 is programmed to skip Sundays, causing the mailbox to remain in the night storage position 18 until Monday morning. If no mail is delivered on any given day, the timer will send the mailbox to the night storage position at a predetermined time of day.

As the mailbox travels through its circular arc from the night storage position back to the original mail delivery position, peg 21 likewise approaches limit switch 5 until the bottom of peg 21 engages the raised rocker arm of limit switch 5. Activation of limit switch 5 by peg 21 stops the motor by breaking the power to the relay coil, causing the spring loaded contacts to break the reverse polarity connection and to make the original connections.

At this point, mailbox 11 has moved from its night storage position 18 (FIG. 3), traveling in the opposite direction from which it traveled from the mail delivery position to the night storage position, to the delivery position 14. During this process, limit switches 2 and 4 are reset to their original configuration as they are actuated once again by pegs 12 and 16, respectively.

As the cycle starts again with the next day's mail delivery, switch 1 is activated once again by the closing of mailbox door 8, and motor 9 again rotates top disk 10 in its original direction. As top disk 10 rotates in its original direction, it likewise carries peg 21 back towards limit switch 5 and ultimately causes limit switch 5 to reset as peg 21 passes over limit switch 5.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. An automatic variable position mailbox system for translating a mailbox through a plurality of predesignated positions with respect to a roadside, comprising:

a vertical support post;

a horizontal arm pivotally attached to said vertical support post having a first end and a second end;

said mailbox fixedly attached to said first end of said horizontal arm; and means for automatically rotating said mailbox through a horizontal arc from a first predesignated position adapted to be adjacent said roadside, to a second predesignated position along said horizontal arc and adapted to be spaced apart from said roadside, to a third predesignated position along said horizontal arc and adapted to be spaced apart from said roadside and said second position, and back to said first position.

2. The automatic variable position mailbox system of claim 1, said means for automatically rotating said mailbox through said horizontal arc further comprising:

a rotatable disc affixed to said horizontal arm and rotatably mounted to said vertical support post;

a first electrical switch fixedly attached to said mailbox and operable by closure of a door attached to said mailbox, said first electrical switch being in electrical communication with a first power circuit to initiate rotation of said mailbox through said horizontal arc from said first position towards said second position;

a second electrical switch fixedly attached to said vertical support post below said rotatable disc; and means on said rotatable disc for operating said second switch to terminate rotation of said mailbox through said horizontal arc when said mailbox has reached said second position.

3. The automatic variable position mailbox system of claim 2, said first electrical power circuit comprising a power source, said first electrical switch, a driving motor operatively engaged to said rotatable disc, and a first electrical timer circuit disposed between said first electrical switch and said driving motor, said first electrical timer circuit causing a time delay between closure of said mailbox door and directing electrical current to said driving motor to rotate said mailbox through said horizontal arc from said first position to said second position.

4. The automatic variable position mailbox system of claim 3, said first electrical timer circuit further comprising a timer for terminating delivery of electrical current to said driving motor after a predetermined amount of time of driving motor operation has elapsed.

5. The automatic variable position mailbox system of claim 3, said first electrical switch being in electrical communication with a second power circuit to initiate rotation of said mailbox through said horizontal arc from said second position towards said third position, and said means for automatically rotating said mailbox through said horizontal arc further comprising:

a third electrical switch fixedly attached to said vertical support post below said rotatable disc; and means on said rotatable disc for operating said third switch to terminate rotation of said mailbox through said horizontal arc when said mailbox has reached said third position.

6. The automatic variable position mailbox system of claim 5, said second electrical power circuit comprising a power source, said first electrical switch, said driving motor operatively engaged to said rotatable disc, and a second electrical timer circuit disposed between said first electrical switch and said driving motor, said second electrical timer circuit causing a time delay between closure of said mailbox door and directing electrical current to said driving motor to rotate said mailbox through said horizontal arc from said second position towards said third position.

7. The automatic variable position mailbox system of claim 6, said first electrical timer circuit further comprising a timer for terminating delivery of electrical current to said driving motor after a predetermined amount of time of driving motor operation has elapsed.

8. The automatic variable position mailbox system of claim 6, said means for automatically rotating said mailbox through said horizontal arc further comprising:

a timer switch in electrical communication with a third power circuit to initiate rotation of said mailbox through said horizontal arc from said third position towards said first position in a direction opposite to that in which the mailbox traveled from said first position towards said third position;

a fourth electrical switch fixedly attached to said vertical support post below said rotatable disc; and means on said rotatable disc for operating said fourth switch to terminate rotation of said mailbox through said horizontal arc when said mailbox has returned to said first position.

9. The automatic variable position mailbox system of claim 8, said third electrical power circuit comprising said power source, said timer switch, and said driving motor, said timer switch directing electrical current to said driving motor at a predetermined time of day to rotate said mailbox through said horizontal arc from said third position towards said first position in a direction opposite to that in which the mailbox traveled from said first position towards said third position.

10. The automatic variable position mailbox system of claim 1, said horizontal arm further comprising a telescopically extensible section, and said mailbox being fixedly attached to said extensible section.

11. The automatic variable position mailbox system of claim 10, said horizontal arm further comprising a housing, and a power source for driving said mailbox through said horizontal arc and a counterweight disposed in said housing.

12. The automatic variable position mailbox system of claim 1 further comprising:

a rotatable disc affixed to said horizontal arm and rotatably mounted to said vertical support post;

a driving motor mounted to said vertical support post and operatively engaged to said rotatable disc; and a resilient member biasing said driving motor against said rotatable disc.

13. An automatic variable position mailbox system for translating a mailbox through a plurality of predesignated positions with respect to a roadside, comprising:

a vertical support post;

horizontal arm pivotally attached to said vertical support post having a first end and a second end;

said mailbox fixedly attached to said first end of said horizontal arm, said mailbox having a door; and first means for automatically translating said mailbox through a horizontal arc from a first predesignated position adapted to be adjacent said roadside to a second predesignated position along said horizontal arc and adapted to be spaced apart from said roadside, said first means being responsive to closure of said mailbox door.

14. The automatic variable position mailbox system of claim 13, further comprising:

second means for automatically translating said mailbox through said horizontal arc from said second position along said horizontal arc to a third position along said horizontal arc and adapted to be spaced apart from said roadside and said second position, said second means being responsive to closure of said mailbox door.

15. The automatic variable position mailbox system of claim 14, further comprising:

third means for automatically translating said mailbox through said horizontal arc from said third position along said horizontal arc back towards said first position along said horizontal arc, said third means being responsive to an electrical timer mounted on said vertical support post.

16. The automatic variable position mailbox system of claim 15, further comprising switch means mounted to said vertical support post for automatically terminating movement of said mailbox through said horizontal arc when said mailbox has reached said first position, said second position, and said third position.

* * * * *